United States Patent [19]

Rohrbacher

[11] Patent Number: 4,566,501

[45] Date of Patent: Jan. 28, 1986

[54] AUTOMATIC END COATING ATTACHMENT FOR A CHAIN LINK WEAVER

[75] Inventor: Herbert E. Rohrbacher, Whittier, Calif.

[73] Assignee: Bergandi Manufacturing Co., Inc., South El Monte, Calif.

[21] Appl. No.: 734,663

[22] Filed: May 16, 1985

Related U.S. Application Data

[63] Continuation of Ser. No. 483,098, Apr. 8, 1983, abandoned.

[51] Int. Cl.[4] ..... B21F 21/00; B05C 1/00

[52] U.S. Cl. ..... 140/1; 140/92.7; 118/243; 118/263

[58] Field of Search ..... 140/1, 92.3, 92.4, 92.7, 140/92.8; 118/243, 263

[56] References Cited

U.S. PATENT DOCUMENTS

| | | | |
|---|---|---|---|
| 943,723 | 12/1909 | Webster | 118/243 |
| 1,243,353 | 10/1917 | Snedeker | 140/92.8 |
| 1,259,378 | 3/1918 | Doring | 140/92.7 |
| 1,815,480 | 7/1931 | Neal | 118/243 |
| 3,575,135 | 4/1971 | Wallace | 118/243 |

FOREIGN PATENT DOCUMENTS 542388 11/1955 Belgium .

*Primary Examiner*—Lowell A. Larson

*Attorney, Agent, or Firm*—Charles H. Schwartz; Ellsworth R. Roston

[57] ABSTRACT

A coating attachment for a wire weaver for dabbing cut ends of chain link formed by the wire weaver with a protective coating, including mounting the coating attachment at a position adjacent cut ends of chain link after the forming of the chain link by the wire weaver, and with the coating attachment including a receptacle containing a supply of the protective coating, a dabber member for transferring the protective coating from the receptacle to cut ends of chain link, moving the dabber member between a first position within the receptacle for transferring coating material to the dabber member and a second position in contact with the cut ends for transferring coating material from the dabber member to the cut ends, and driving the dabber member in synchronism with the forming of the chain link by the wire weaver.

14 Claims, 7 Drawing Figures

AUTOMATIC END COATING ATTACHMENT FOR A CHAIN LINK WEAVER

This is a continuation of application Ser. No. 483,098, filed Apr. 8, 1983 abandoned.

BACKGROUND OF THE INVENTION

1. Field of the Invention

The present invention is directed to a coating attachment for a wire weaver. Specifically the present invention is an assembly for dabbing a protective coating such as paint on the ends of chain link formed by the wire weaver.

2. Description of the Prior Art

In the manufacture of chain link for fencing, individual wire from rolls is coiled and the coils are woven together and then cut to form the chain link. Although the wire may be galvanized or plastic coated, the cut ends are exposed and can rust and deteriorate after such exposure to the elements.

It is desirable therefore, to coat the cut ends of the chain link with paint or other protective material. In the prior art, attempts have been made to coat the ends of the chain link but generally these attempts have involved a cumbersome hand operation. For example, an operator may actually use a paint brush to dab the ends with paint or may use a spray to spray the ends. The use of such hand operations is highly labor intensive and the results are inconsistent. Moreover, the use of a paint brush or spray does not insure that a sufficiently thick enough coating of paint or other protective material is applied to the cut ends.

SUMMARY OF THE INVENTION

The present invention is directed to an assembly which is attached to an automatic chain link weaving machine which provides for dabbing the cut ends of the chain link with a plate member coated with a liquid substance such as paint, so as to transfer a sufficient quantity of paint to the cut ends to coat and seal the cut ends of the chain link. The plate member is actuated from a supply position, where the plate member receives a quantity of paint, to an operating position in contact with the ends of the chain link, and with the plate member universally adaptable in position to adjust to variations in the cut ends of the chain link to insure that the cut ends always receive a sufficient quantity of paint.

In particular, the paint dabbing assembly is driven by a drive portion of the chain link weaver to insure that the paint dabbing assembly is in sychronism with the chain link drive. Specifically, a cam structure may be coupled to a take up drive, and with the cam structure actuating a number of pivoted arms so as to operate a paint dabbing plate from the supply position, to receive the paint, to the operative position to apply the paint to the cut ends of the chain link. The pivoted arms produce the desired motion of the paint dabbing plate and the paint dabbing plate is mounted with an universal type joint to compensate for any irregularities in the cut ends of the chain link.

BRIEF DESCRIPTION OF THE DRAWINGS

A clearer understanding of the invention will be had with reference to the following description and drawings wherein.

DESCRIPTION OF THE PREFERRED EMBODIMENTS

Figure 1:
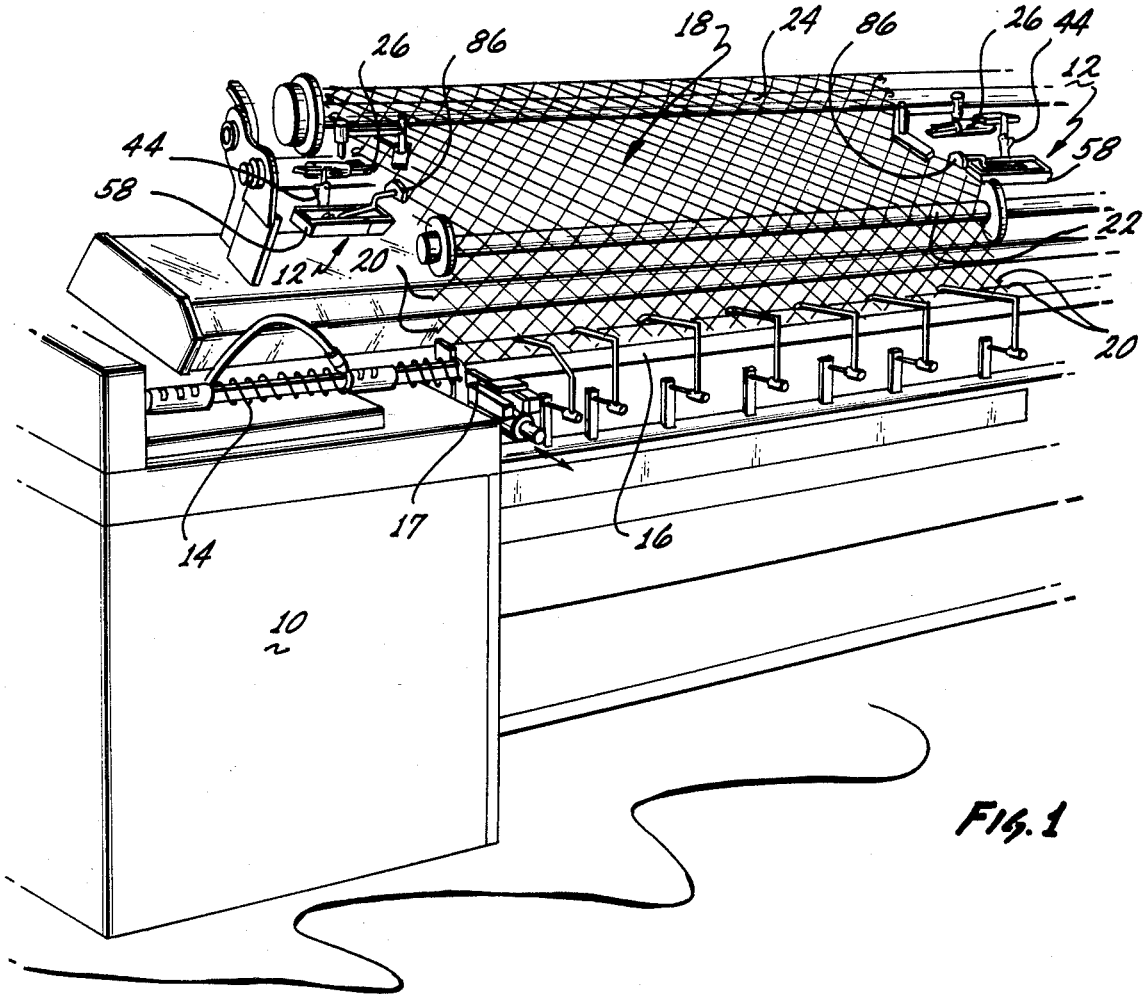
FIG. 1 illustrates an automatic wire weaver for producing chain link and incorporating a dabber assembly of the present invention at a position intermediate a weaving position and a turret position.

FIG. 1 shows an automatic wire weaver 10 for the production of chain link and incorporating paint dabber assemblies 12 of the present invention. Two (2) assemblies 12 are shown located on opposite sides of the chain link as it exits the wire weaver. The wire weaver 10 itself may be of an automatic two (2) wire type wherein wire from large coils of wire (not shown) are continuously fed into a coiling mechanism 14 so that two wires at a time are intercoiled and then woven by a weaving mechanism 16 to form continuous lengths of chain link 18. After weaving the wire is cut by cutter means 17 so that opposite ends 20 of the chain link 18 are freshly cut. The chain link 18 may be made of material such as galvanized material or plastic coated material which is generally resistant to weather. However, the freshly cut ends 20 are not protected and could become rusted and deteriorate when subject to the weather over a period of time. The present invention provides for the paint dabber assembly 12 to dab the cut ends 20 of the chain link 18 with a protective coating, such as a protective paint, to seal the cut ends 20 and prevent the cut ends from rusting and weathering.

Figure 4:
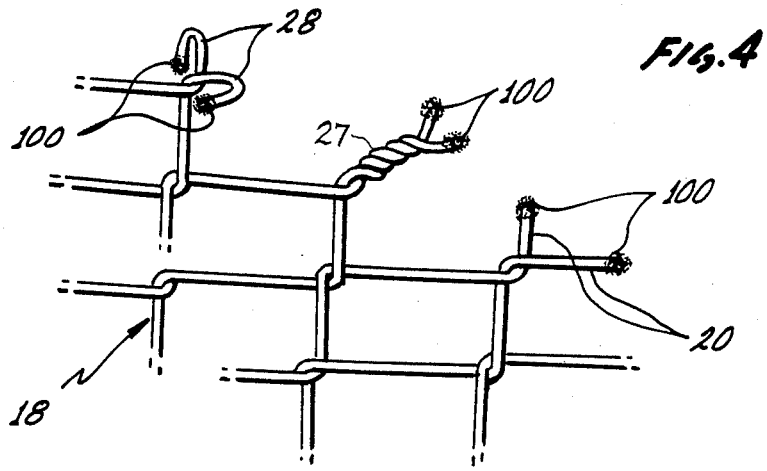
FIG. 4 illustrates a portion of a chain link showing cut ends coated with the protective material and either having barbed ends or knuckled ends.
Figure 3:
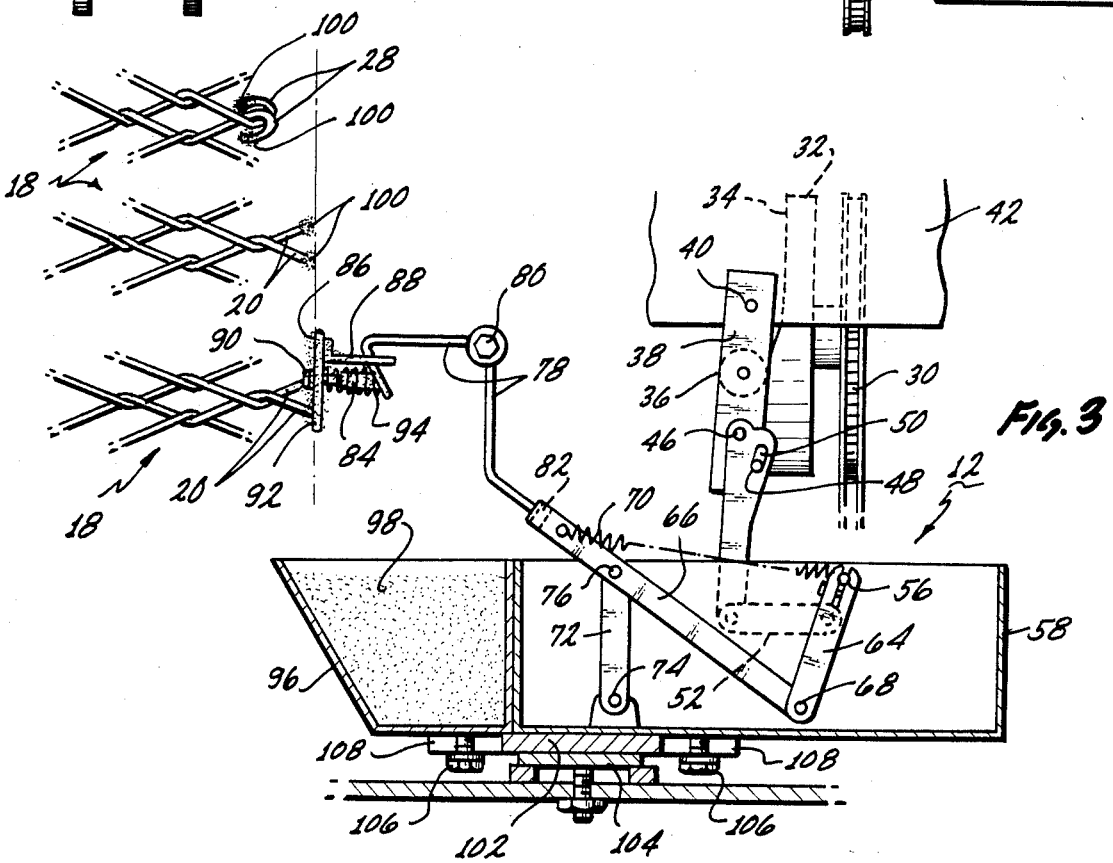
FIG. 3 illustrates a side view of the dabber assembly of the present invention and with the dabber plate in the contact position to apply the coating material to the cut ends of the chain link.

The chain link 18 as it exits from the wire weaving machine 10 generally passes over rollers 22 and 24. The chain link is held in a stretched out position as it passes over the rollers 22 and 24. The paint dabber assembly 12 is located intermediate the rolls 22 and 24 to coat the cut ends 20 of the stretched chain link 18. Subsequent to coating the ends 20 it is usually desirable to further modify the ends by turrets such as by knuckling the ends over. The knuckling may be accomplished by the use of turret knucklers 26 to produce a knuckled end 28 for the chain link fence as shown in FIGS. 3 and 4. As an alternative, the ends may be barbed by barbing turrets which further twist the ends 20 to lock the ends together and have the sharply cut ends protrude outwardly as shown in FIG. 4. The use of such barbing or knuckling turrets are common and any standard type of barbing or knuckling turrets may be used with the present invention.

As the chain link 18 is formed by the coiling, weaving and cutting mechanisms 14, 16 and 17, the formation occurs in increments since each pair of wires are woven while the completed chain link 18 remains stationary. Once each pair of wires is woven onto the end of the chain link 18, the completed chain link is moved incrementally over the guide rollers 22 and 24 by a take-up unit (shown in FIG. 2) to position the chain link to receive the next pair of wires for weaving. Typically the barbing or knuckling of the ends 20 occur with the chain link 18 in its stationary position. In a similar fashion, the paint dabber assembly 12 provides for the cut ends 20 to be coated while the chain link 18 is in the stationary position. The take-up unit is driven intermittently to provide for the desired incremental movement of the chain link 18 and therefore the paint dabbing assembly 12 as well as other auxiliary assemblies such as the barbing or knuckling attachments may be all driven in accordance with the intermittent movement of the take-up unit.

Figure 2:
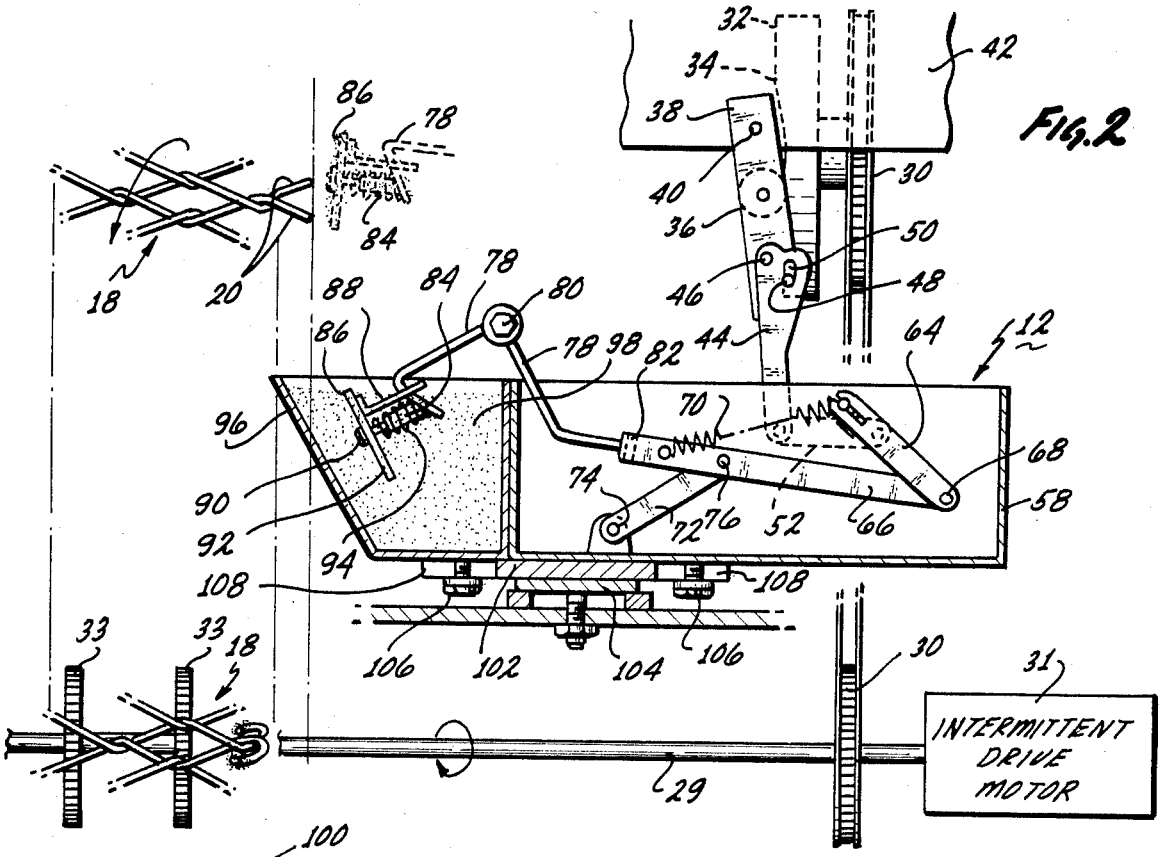
FIG. 2 illustrates in detail a side view of the dabber assembly of the present invention and with the dabber plate positioned to receive a fresh supply of coating material.

In particular, the paint dabbing assembly 12 may be driven directly off a chain drive 30 which chain drive may be driven by the take-up unit. This is shown in FIG. 2, where the chain 30 is coupled to a shaft 29 driven at one end by a motor 31. Mounted along the shaft 29 are a plurality of cogs 33 which extend along the width of the chain link 18. The motor 31 intermittenly rotates the shaft 29 to provide take-up in synchronism with the wire weaving. A cam 32 having an outer cam surface 34 is directly coupled to the chain drive 30. The cam profile 34 has essentially two (2) extreme levels so that a roller 36 will follow the cam profile 34 between these two (2) levels. This can be seen clearly in FIGS. 2, 3 and 5. The roller 36 is attached to an arm member 38 and with the roller 36 freely rotating to follow the cam profile 34 while at the same time forcing the arm member 38 to also follow the cam profile 34. The arm member is pivoted around a pivot point 40 which pivot point is attached to a fixed surface 42. As can be seen in FIGS. 2 and 3, the arm member 38 pivots around the pivot point 40 as the roller 36 follows the cam profile 34.

Extending from the arm member 38 is an adjustable arm member 44. The arm member 44 is attached to the arm member 38 but allows for a small pivoting adjustment since the arm member 44 may pivot slightly around attachment point 46. Once adjusted the arm 44 is locked in position through the use of a locking means 48 passing through a slot 50. Specifically, the locking means 48 may be a bolt which passes through the slot 50 into a threaded opening in the arm member 38 so that the arm member 44 may be pivoted around the pivot point 46 to a desired position and then locked in this position by tightening down the bolt 48.

At the end of the adjustable arm 44, a pivot arm 52 is attached to extend substantially perpendicular to the arm 44 and with the pivot arm 52 attached to a follower arm 54. The follower arm 54 is more clearly shown in FIGS. 5 and 6. One end of the follower arm 54 is pivotally attached to the pivot arm 52 while the other end of the follower arm 54 is fixed to an outside portion of a shaft 56. This is clearly shown in FIGS. 5 and 6, where the shaft 56 is shown to extend across a box structure 58 and held for rotation by bearings 60 and 62. The shaft 56 therefore rotates as the follower arm 54 rotates and with the follower arm 54 rotated by movement of the pivot arm 54 and the arm members 38 and 44. The movement of the arm members 38 and 44 is in turn controlled by the roller 36 following the cam profile 34 as the cam 32 is rotated by the chain drive 30.

A lifting lever 64 is fixedly attached to the shaft 56 so as to rotate in accordance with the rotation of the shaft 56. Extending from and pivotably attached to the lifting lever 64 is a long arm 66. The lifting lever 64 and long arm 66 are pivotably attached at point 68. An extension spring 70 is connected between the long arm 66 and the shaft 56 so as to tend to pull the long arm 66 toward the shaft 56. A guide arm 72 extends from a fixed pivot point 74 to a pivot point 76 along the length of the long arm 66. The guide arm 72 pivots around the fixed pivot point 74 as the paint dabbing assembly 12 is moved between the positions shown in FIGS. 2 and 3. In particular, as shown in FIG. 3, the guide arm 72 has a substantially upright position whereas in FIG. 2 the guide arm 72 has been rotated away from the upright position and towards a horizontal position. This causes the free end of the long arm 66 to be thrust up and out as the paint dabber assembly 12 is moved from the position shown in FIG. 2 to the position shown in FIG. 3. This movement of the free end of the long arm 66 is in accordance with the cam roller 36 following the profile 34 of the cam 32.

At the free end of the long arm 66, a main arm 78 is supported which main arm is formed of two (2) elements coupled together by a locking bolt 80. The angular relationship between the two (2) elements of the main arm 78 may be adjusted and then retained in the adjusted position by tightening the bolt 80. One end of the main arm 80 is attached to the free end of the long arm 66 at position 82. A post 84 extends from the main arm 78 at the other end of the main arm.

A dabber plate 86 is mounted to the post 34 of the end of the main arm 78 to allow for universal movement of the dabber plate so as to insure the proper. transfer of coating material, such as paint, to the ends 20 of the chain link 18. In particular, the dabber plate 86 includes a slotted keeper 88 which extends backwardly from the dabber plate to have the slot portion of the keeper extend around the main arm 78. The keeper allows movement of the dabber plate relative to the main arm 78 but prevents rotation of the dabber plate around the main arm 78. The dabber plate 86 is attached to the post 84 by a screw member 90 which passes through an opening 92 in the dabber plate 86 and with the screw member received within a threaded opening in the post 84. The screw member 90 has an enlarged head but with the shaft portion of the screw member smaller than the opening 92. This insures that the dabber plate 86 may rock universally in any direction, as shown by the arrows in FIGS. 5 and 7, but with the slotted portion of the keeper 88 preventing rotation of the dabber plate relative to the arm 78.

In order to keep the dabber plate 86 in a generally upright position while contacting the ends 20 of the chain link 18, a compression spring 94 fits over the post 84 and extends between the back of the dabber plate 86 and the end of the arm 78 and pushes against the back of the dabber plate 86. The spring compression, of course, may be overcome as the surface of the dabber plate 86 contacts the ends 20 of the chain link 18 so that the dabber plate 86 may assume a proper contact position with the ends 20 such as shown in FIG. 3.

Figure 5:
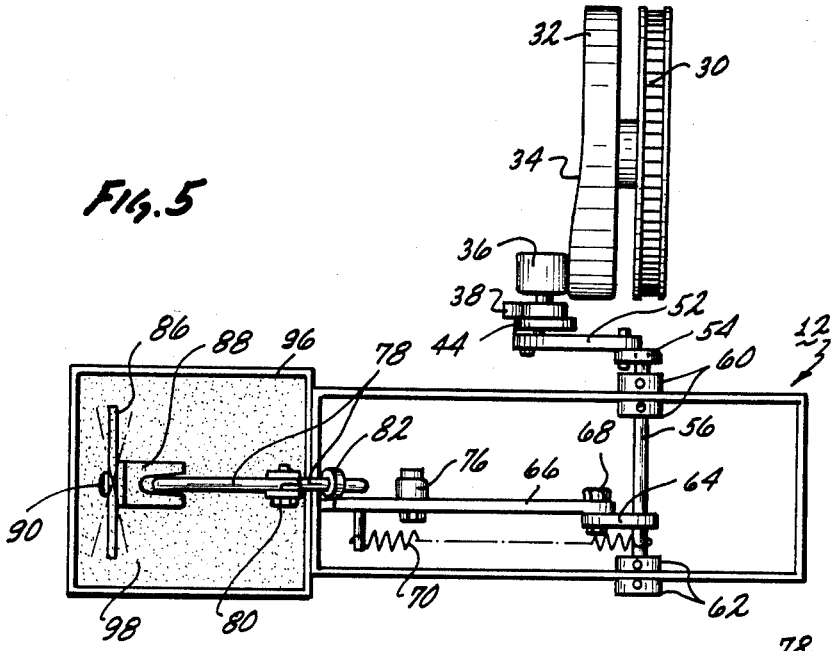
FIG. 5 illustrates a top view of the dabber assembly of the present invention and with the dabber plate at the contact position.
Figure 7:
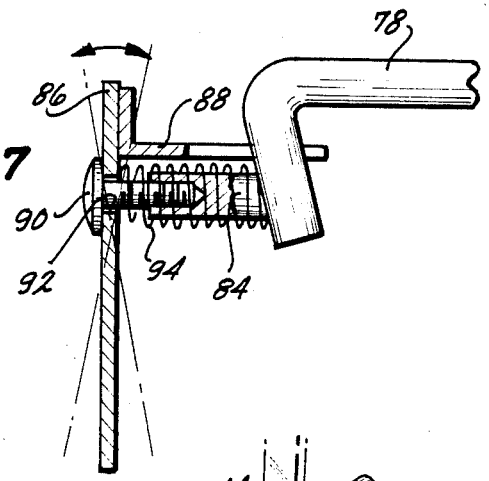
FIG. 7 is an enlarged detailed view of the dabber plate and holder and showing the universal movement of the dabber plate to adjust for differences in the cut ends of the chain link.
Figure 6:
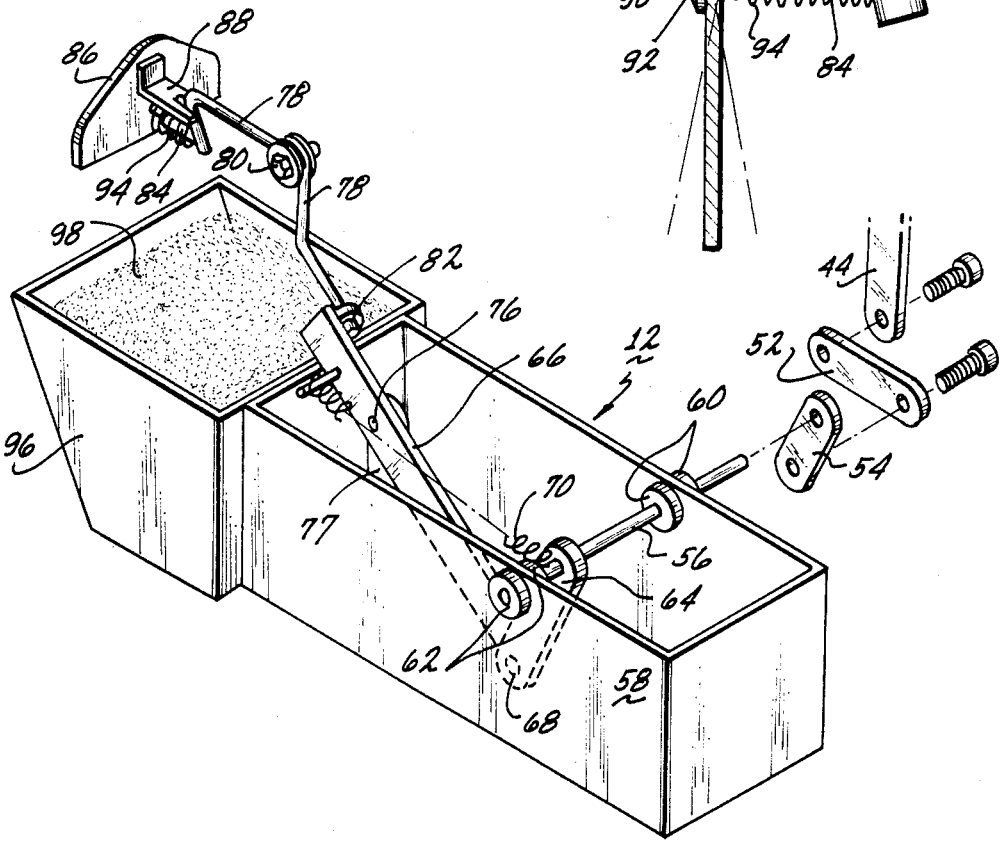
FIG. 6 illustrates a perspective view of the dabber assembly of the present invention and with the dabber plate at the contact position.

The paint dabber assembly 12 includes a tray 96 containing a supply of coating material such as paint 98. In the position shown in FIG. 2, the dabber plate 86 is submerged in the coating material 98. In this position, the dabber plate receives a fresh supply of coating material. As the dabber plate is lifted upward and outward from the position shown in FIG. 2 to the position shown in FIG. 3, any excess coating material will fall downwardly into the tray 96. The position of the dabber plate just prior to contact with the ends 20 is shown in the dotted position in FIG. 2. At the time of contact the dabber plate is pushed against the ends 20 and any irregularity in the ends 20 or between the ends 20 is compensated since the dabber plate will universally rock as shown in FIGS. 5 and 7 so as to provide the proper contact with the ends 20. A portion of the coating material on the surface of the dabber plate is now transferred to the ends 20. The dabber plate 86 contains a sufficient quantity of coating material 98 so as to insure a proper transfer of the coating material to completely cover the cut portions of the ends 20. The coated ends are shown at position 100. As a further step after coating, the ends 20 may be knuckled to produce the knuckled ends 28 shown in FIG. 3. Alternatively, the ends 20 may be further twisted so as to produce a barbed end 27 as shown in FIG. 4.

In addition to the adjustments between the different arm members as described above, the entire paint dabber assembly may be adjusted by a slide mechanism 102 located on the underside of the box 58 and tray 96. In particular, the box and tray may be slid relative to the hold down structure 104 through the use of bolts 106 located in slots 108.

The present invention therefore provides for the coating of the cut ends of chain link, and with the coating accomplished using a multi arm structure for translating a rotational caming motion to a linear motion to have the multi arm structure move a dabber plate from a first position, wherein the dabber plate is immersed in a supply of coating material, to a second position where the dabber plate is moved into and against the cut ends of the chain link, so as to transfer the coating material to the cut ends and with the dabber plate having universal rocking motion to accommodate irregularities in the cut ends. The dabber plate assembly of the present invention provides for the movement of the dabber plate using positive pivoted arms directly driven by a cam action so as to insure that the same motion occurs each time so that each pair of cut ends is properly coated with protective material.

Although the invention has been described with reference to a particular embodiment it should be appreciated that various adaptations and modifications may be made and the invention is only to be limited by the appended claims.

I claim:

1. A coating attachment for a wire weaver for dabbing cut ends of chain link formed by the wire weaver with a protective coating, including means for mounting the coating attachment at a position adjacent cut ends of chain link after the forming of the chain link by the wire weaver, the coating attachment including, a receptacle containing a supply of the protective coating, a dabber member for transferring the protective coating from the receptacle to cut ends of chain link and wherein the dabber member is formed as a plate member, first means coupled to the dabber member for moving the dabber member between a first portion within the receptacle for transferring coating material to the dabber member and a second position in contact with the cut ends for transferring coating material from the dabber member to the cut ends and with the plate member forming the dabber member coupled to the first means by a universal joint to provide for the plate member adjusting in position when in contact with the cut ends second means coupled to the first means for driving the first means to move the dabber member in synchronism with the forming of the chain link by the wire weaver.

the wire weaver including a take-up unit and with the second means coupled to the take-up unit to in turn drive the first means, the second means including a rotatable cam assembly coupled to the take-up unit, and the first means formed by a plurality of pivoted arms coupled to the rotatable cam assembly for translating the rotatable movement to a movement for the dabber member up and out of the receptacle.

2. The coating attachment of claim 1 including two dabber members and with the mounting means mounting the two dabber members on opposite sides of the chain link formed by the wire weaver.

3. The coating attachment of claim 1 wherein the take-up unit positioned for taking up the chain link formed by the wire weaver and with the mounting means mounting the coating attachment before the position of the take-up unit.

4. The coating attachment of claim 1 wherein the receptacle forms a tank containing a protective paint.

5. A wire weaver including a coating attachment for dabbing cut ends of chain link formed by the wire weaver with a protective coating, including coiling means for coiling lengths of wire for weaving into chain link, weaving means coupled to the coiling means for weaving the lengths of coiled wire together to continuously form the chain link, cutting means for cutting each length of wire after weaving, means for mounting the coating attachment at a position adjacent cut ends of chain link after the forming of the chain link by the weaving means, the coating attachment including, a receptacle containing a supply of the protective coating, a dabber member for transferring the protective coating from the receptacle to cut ends of chain link and wherein the dabber member is formed as a plate member, first means coupled to the dabber member for moving the dabber member between a first position within the receptacle for transferring coating material to the dabber member and a second position in contact with the cut ends for transferring coating material from the dabber member to the cut ends, the plate member coupled to the first means by a universal joint to provide for the plate member adjusting in position when in contact with the cut ends, and second means coupled to the first means and to a drive mechanism for driving the first means to move the dabber member in synchronism with the forming of the chain link by the wire weaver.

6. The wire weaver of claim 5 including two dabber members and with the mounting means mounting the two dabber members on opposite sides of the chain link formed by the weaving means.

7. The wire weaver of claim 5 wherein the wire weaver includes a take-up unit positioned for taking up the chain link formed by the weaving means and with the mounting means mounting the coating attachment before the position of the take-up unit.

8. The wire weaver of claim 5 wherein the receptacle forms a tank containing a protective paint.

9. The wire weaver of claim 8 wherein the first means moves the plate member to the first position wherein the plate member is immersed in the protective paint contained in the tank.

10. The wire weaver of claim 5 wherein the first means is formed by a plurality of pivoted arm members interconnecting the dabber member with the second means to translate movement of the second means to movement of the dabber member between the first and second positions.

11. The wire weaver of claim 10 wherein the second means includes a rotatable cam assembly and with the plurality of pivoted arms translating the rotatable movement to movement of the dabber member up and out of the receptacle.

12. The wire weaver of claim 5 wherein the wire weaver includes a take-up unit and with the second means coupled to the take-up unit to in turn drive the first means.

13. The wire weaver of claim 12 wherein the second means includes a rotatable cam assembly coupled to the take-up unit.

14. The wire weaver of claim 13 wherein the first means is formed by a plurality of pivoted arms coupled to the rotatable cam assembly for translating the rotatable movement to a movement for the dabber member up and out of the receptacle.

* * * * *